US008485364B2

(12) United States Patent
Krush et al.

(10) Patent No.: US 8,485,364 B2
(45) Date of Patent: Jul. 16, 2013

(54) MULTIFREQUENCY SIEVE ASSEMBLY FOR CIRCULAR VIBRATORY SEPARATOR

(75) Inventors: Iona Krush, Ashdod (IL); Yuri Obodan, Beer Sheva (IL)

(73) Assignee: Kroosh Technologies, Ashdod (IL)

( * ) Notice: Subject to any disclaimer, the term of this patent is extended or adjusted under 35 U.S.C. 154(b) by 0 days.

(21) Appl. No.: 13/251,397

(22) Filed: Oct. 3, 2011

(65) Prior Publication Data

US 2012/0024764 A1 Feb. 2, 2012

(51) Int. Cl.
*B07B 1/34* (2006.01)

(52) U.S. Cl.
USPC ..... 209/326; 209/365.1

(58) Field of Classification Search
USPC ..... 209/309, 311, 315, 355, 365.1, 317, 209/325, 326, 331, 332, 365.4, 379, 382
See application file for complete search history.

(56) References Cited

U.S. PATENT DOCUMENTS 1,229,812 A * 6/1917 Sturtevant ..... 209/245
5,398,816 A * 3/1995 Senapati ..... 209/364
5,542,548 A * 8/1996 Senapati ..... 209/365.1
5,799,799 A * 9/1998 Alamzad et al. ..... 209/365.1
5,915,566 A * 6/1999 Senapati ..... 209/365.1
2005/0072717 A1* 4/2005 Purohit et al. ..... 209/309

* cited by examiner

*Primary Examiner* — Joseph C Rodriguez
*Assistant Examiner* — Kalyanavenkateshware Kumar
(74) *Attorney, Agent, or Firm* — Nadya Reingand

(57) ABSTRACT

The invention is intended for sizing separation of difficult-to-screen powder materials and slurries. A sieve assembly includes a rigid frame, attached inside the separator housing, and upper and bottom sieves, stretched on the frame. The interface apparatuses are connected to the upper sieve, while actuator means—to the bottom sieve. The forced frequency of the vibrator is close to one of the natural frequencies of the bottom sieve. When the vibrator is operated, the actuator means interact with interface apparatuses, thus generating repeated collisions therebetween and mechanical impulses, which provide multifrequency excitation of the interface apparatuses and upper sieve. This ensures continuous self-cleaning of the upper sieve, intense loosening of the material bed and disintegration of the particle agglomerates. Separation capacity and products' quality substantially rises. In other embodiments presented sieve assembly includes buffer elements and inertial apparatuses, connected to the upper sieve.

11 Claims, 10 Drawing Sheets

10

122
11
12
13
14a
14b
15
gap δ
B
B
C
C
124
121
125
17
16
18
A

A 17
18
11
16
16
10

A-A

B-B

MULTIFREQUENCY SIEVE ASSEMBLY FOR CIRCULAR VIBRATORY SEPARATOR

CROSS-REFERENCE TO RELATED APPLICATIONS

This application is based on Russian patent application #2011137201 filed on Sep. 9, 2011 and two preceding Israeli patent applications: #203145, filed on Jan. 5, 2010 and # 214810, filed Aug. 24, 2011.

FIELD OF THE INVENTION

The present invention generally relates to material separation and, more particularly, to vibratory and tumbler sieve separation of particulate solids up to pre-selected sizes from a material having particles of different sizes, and including the separation of particles from bulk materials and from slurries.

BACKGROUND OF THE INVENTION

It is widely known, that conventional vibratory and tumbler separator methods and devices are generally ineffective when applied to certain materials, such as fine and highly cohesive powders, wet and sticky bulk materials, fiber materials and generally, so-called "difficult-to-screen" materials because the sieves used for sieving of such materials are prone to clogging and blinding and materials have a significant tendency to agglomerate. It is also known numerous cleaning devices for sieve separators, such as disclosed in patents: U.S. Pat. Nos. 7,416,085, 6,422,394, 5,398,816, 5,143,222, 4,929,346, 4,122,006, etc. Several technical solutions, which are the most relevant to the present invention, are reviewed bellow.

By way of example, U.S. Pat. No. 4,929,346 to Si-Lin discloses a self-cleaning screen assembly including a main screen put flatly on a coarser support screen and a ball tray carrying plastic rings and rubber balls to provide self-cleaning of the screens by bouncing and tapping of the rings and balls between the tray and support screen when they are subjected to vibratory excitation together with housing of the separator.

The similar self-cleaning sieve assembly is sold by SWECO corporation of Florence, KY, USA under trade name "SWECO Sandwich Screens" (see http://www.sweco.com/products_partscreens_screens_sandwich.html of 2009, Oct. 24). The sieve assembly is comprised of a working mesh screen on top of the tension ring with a coarser support screen attached to the bottom of the ring with sliders and/or balls placed between the meshes. The sliders and balls will bounce off of the support screen and tap the top screen to dislodge near-size particles or fibers that tend to blind the screen and reduce screening area.

Disadvantages of these systems include relatively low energy transfer to the sieve, insufficient de-agglomeration and sifting of "difficult-to-screen" materials.

There are also known separation devices, which employ double frequency excitation. These devices, for example, combine use of a low frequency vibration, typically in the range 5-30 Hz, with ultrasonic excitation at 20-50 kHz, provided by means of an electromechanical transducers fed by an electronic generator, which provide high-frequency vibrations of a sieve. By way of example, U.S. Pat. No. 5,398,816 to Senapati discloses a typical screening system having a resiliently mounted frame with a screen extending thereacross. The frame is vibrated by a low frequency vibratory drive using eccentric weights. About the peripheral frame of the screen, a high frequency drives are employed to vibrate the screen in the range of 20,000 Hz. Disadvantages of this system include relatively low energy transfer to the sieve fabric and insufficient de-agglomeration efficiency. Also the cost of ultrasonic systems is high together with current expenses on frequent replacement of worn and torn fine sieves.

Another dual frequency device is a screen energizer disclosed in U.S. Pat. No. 7,182,206 to Hukki et all. A screening system including a vibratory screen separator having a resiliently mounted frame with a low frequency vibratory drive coupled to that frame. A taut screen is rigidly mounted in the frame and a vibration transmitter assembly is resiliently mounted to the frame and fixed to the taut screen. The vibration transmitter includes a planar ring compressed against the taut screen and vibration generators. The vibration generators are air turbines with eccentric weights. The frame includes support elements extending from the cylindrical outer housing sections of the separator to a concentrically mounted support ring. Compressed air is provided to the turbines through hollow structure within the frame. Valves control exhaust from the turbines. The low frequency vibratory drive operates in a range of about 8 Hz to 30 Hz while the vibration generators provided by the air turbines operate in a range of about 275 Hz to 600 Hz. Among the main disadvantages of this device are relatively narrow band spectrum excitation and a low transference of mechanical energy to the screen, causing low performance, besides, complexity and operation inconvenience due to necessity in additional vibratory source of one more energy type.

Cleaning device having beating elements is disclosed in U.S. Pat. No. 7,416,085 to Kadel. The device is provided with a sieving mat, which has sieving openings, and with beating elements, which are located underneath the sieving mat and which strike against the underside of the sieving mat in order to free the sieving mat from material to be sieved that is clogging the sieving openings. Said beating elements are fastened to at least one elongated tensioned traction mechanism such as a cable or band that extends underneath the sieving mat.

Main disadvantages of beating devices of this and similar kinds, when used for fine screening, are connected with fast wear and tear of the sieve due to a local application of impact pulses, limited zone of cleaning action at the sieve surface and insufficient de-agglomeration of material to be screened.

Self-cleaning separation systems, having efficient screening performance due to generation of multifrequency vibration having a wide band frequency spectrum are disclosed in U.S. Pat. No. 6,845,868 to the Inventors. Typically a multifrequency separator includes a housing, a source of single frequency vibration, and a mechanical converting system, which converts single frequency vibration of housing into a sequence of mechanical pulses applied to an interface apparatus, thereby to generate a multifrequency vibration of the sieve so that to provide de-agglomeration and efficient segregation of the material bed, and to prevent blockage of the sieve. The interface apparatus also protects fine sieve from local impact loads and thus prolongs sieve lifetime between replacements. Multifrequency separating systems, designed as inserts to existing vibratory separators as well as autonomous machines constructed from the outset are proved to provide a stable blind-free separation of numerous difficult-to-screen materials. However, when compared to conventional separators, these systems: have more complicated design, require more precise assembling and tuning, and enlarge overall dimensions of the machine.

SUMMARY OF THE INVENTION

It is thus an aim of the present invention to provide an improved sieve assembly for vibratory or tumbler separator capable for sizing of fine and ultra-fine powder as well as other difficult-to-screen materials, classification thereof, characterized by continuous sieve self-cleaning and providing disintegration of particle agglomerates during use.

It is another object of the present invention to provide an improved sieve assembly for vibratory separator having an increased screening capacity when compared with prior classification systems, and which improves the separation quality of end products formed of difficult-to-screen materials which have a tendency to plug or peg vibratory sieve openings with "near-sized" particles of a size similar to that of the sieve openings, or which tend to clog the sieve openings with sticky or wet particles.

It is still another object of the present invention to provide a sufficient level of multifrequency mechanical excitation of the sieve which utilizes high-peak acceleration of the sieve surface and necessary repeated impulses of forces transferred to material to be screened.

It is still another object of the present invention to provide an efficient sieve assembly for vibratory separator utilizing optimum wide-band spectrum vibration modes of the sieve which are generally stable under conditions of significant fluctuation of material feed rate.

It is still another object of the present invention to provide a simple, inexpensive, reliable and long-lasting device for converting of most prevailing single-frequency vibratory separators to efficient multifrequency non-clogging separators by implementing of simple convertor device, which is built-in inside the sieve assembly.

It is still another object of the invention to provide a multifrequency sieve assembly as having simple tuning and maintenance thereof.

It is still another object of the present invention to provide a compact multifrequency converting system for conventional circular separators without need in enlargement of overall dimensions.

There is thus provided, in accordance with a preferred embodiment of the present invention, a multifrequency self-cleaning sieve assembly for use with a circular vibratory separator, which includes a vibratable housing, elastic support and a source of single frequency excitation. The multifrequency sieve assembly includes a taut upper sieve, a taut bottom sieve, a rigid ring frame arranged for attachment of the sieve assembly to a vibratable housing of the separator and also for mounting of taut upper and bottom sieves, also one or more of interface apparatuses are attached to the upper screen coaxially with regard to said ring frame, as well as one or more actuator means are attached to the bottom sieve. The forced frequency of the source of single frequency vibratory excitation of the separator is close to one of the natural frequencies of the bottom sieve. The actuator means is arranged with regard to the interface apparatuses so that to provide a prescribed repeated collisions and vibratory-impact excitation of the interface apparatuses and associated upper sieve and to cause a multifrequency excitation and self-cleaning of the upper sieve and also de-agglomeration of the material to be screened when the sieve assembly is exposed to the single frequency excitation together with the vibratable housing of the separator. The actuator means are mounted either in touching or non-touching association relative to the interface apparatuses, when in at-rest position.

There is further provided, in accordance with an additional embodiment of the invention, a multifrequency sieve assembly, which includes an additional sieve of prescribed cut size aperture, which flatly superposes over upper surface of the upper sieve and attached at the contour thereto.

Additionally in accordance with a preferred embodiment of the invention, multifrequency self-cleaning sieve assembly includes an upper ring and attachment means and the upper sieve is tensioned at the upper ring and thereafter is attached to the ring frame by the attachment means.

Further in accordance with a preferred embodiment of the invention, multifrequency self-cleaning sieve assembly includes a bottom ring and attachment means, and the bottom sieve is tensioned at the bottom ring which is then fixed to the ring frame by the attachment means.

Additionally in accordance with a preferred embodiment of the invention, the rigid frame includes a mounting element for attachment of the rigid frame to vibratable housing of the separator.

Further in accordance with a preferred embodiment of the invention, at least one interface apparatus is formed as a ring-shaped and arranged coaxially with regard to said ring frame.

Additionally in accordance with a preferred embodiment of the invention, a multifrequency self-cleaning sieve assembly also includes a gap adjustment means to adjust the air gap between the actuator means and interface apparatuses.

Further in accordance with a preferred embodiment of the invention, the gap adjustment means is formed as one or more ring washer spacers inserted in between the rigid frame and bottom ring.

Further in accordance with a preferred embodiment of the invention, the gap adjustment means is formed as one or more ring washer spacers inserted in between the rigid frame and upper ring.

Further in accordance with a preferred embodiment of the invention, the actuator means are covered by lining elements to provide wear-proof contact surfaces.

Further in accordance with a preferred embodiment of the invention, the interface apparatuses are covered by wear-proof lining elements at contact surfaces subjected to impact interactions.

Additionally, in accordance with a preferred embodiment of the invention, sieve assembly includes a taut additional sieve and a montage apparatus to provide possibility of replacement and stretching of the additional sieve, which is attached to the sieve assembly above upper sieve.

In accordance with yet a further preferred embodiment of the invention, there is provided multifrequency sieve assembly where the actuator means is formed as a set of radially elongated actuator elements arranged symmetrically with regard to the center of the rigid frame.

In accordance with yet a further preferred embodiment of the invention, there is provided a multifrequency self-cleaning sieve assembly where the actuator means is formed with possibility of adjustment of mass and inertia moments.

Additionally, in accordance with a preferred embodiment of the invention, multifrequency sieve assembly includes one or more rigid carrying elements fastened to ring frame and one or more buffer apparatuses are attached to upper sieve against rigid carrying elements. Buffer apparatuses are arranged against rigid carrying elements, so that to form unilateral non-holding constraints of the upper sieve in direction normal to the sieve plane with regard to rigid carrying elements. Thus prescribed repeated collisions and transmission of vibratory-impact excitation and multifrequency excitation are provided to the upper sieve so that to cause self-cleaning operation of the upper sieve and de-agglomeration of the material to be screened when sieve assembly is exposed to a single frequency excitation from vibrator together with the housing of the separator. The buffer apparatuses are mounted in either touching or non-touching association relative to rigid carrying elements, when in at-rest position.

Additionally, in accordance with a preferred embodiment of the invention, sieve assembly also includes one or more interface apparatuses attached to said upper sieve.

Additionally, in accordance with a preferred embodiment of the invention, one or more buffer elements are attached to one or more interface apparatuses.

Additionally, in accordance with a preferred embodiment of the invention, one or more inertial apparatuses are attached to the upper sieve.

Additionally, in accordance with a preferred embodiment of the invention, one or more inertial apparatuses are attached to the upper sieve and to one or more interface apparatuses.

Additionally, in accordance with a preferred embodiment of the invention, one or more inertial apparatuses are formed with possibility of adjustment of their mass and moments of inertia.

BRIEF DESCRIPTION OF THE DRAWINGS

The present invention will be more fully understood and appreciated from the following detailed description, taken in conjunction with the drawings, in which.

DETAILED DESCRIPTION OF THE INVENTION

Figure 1:
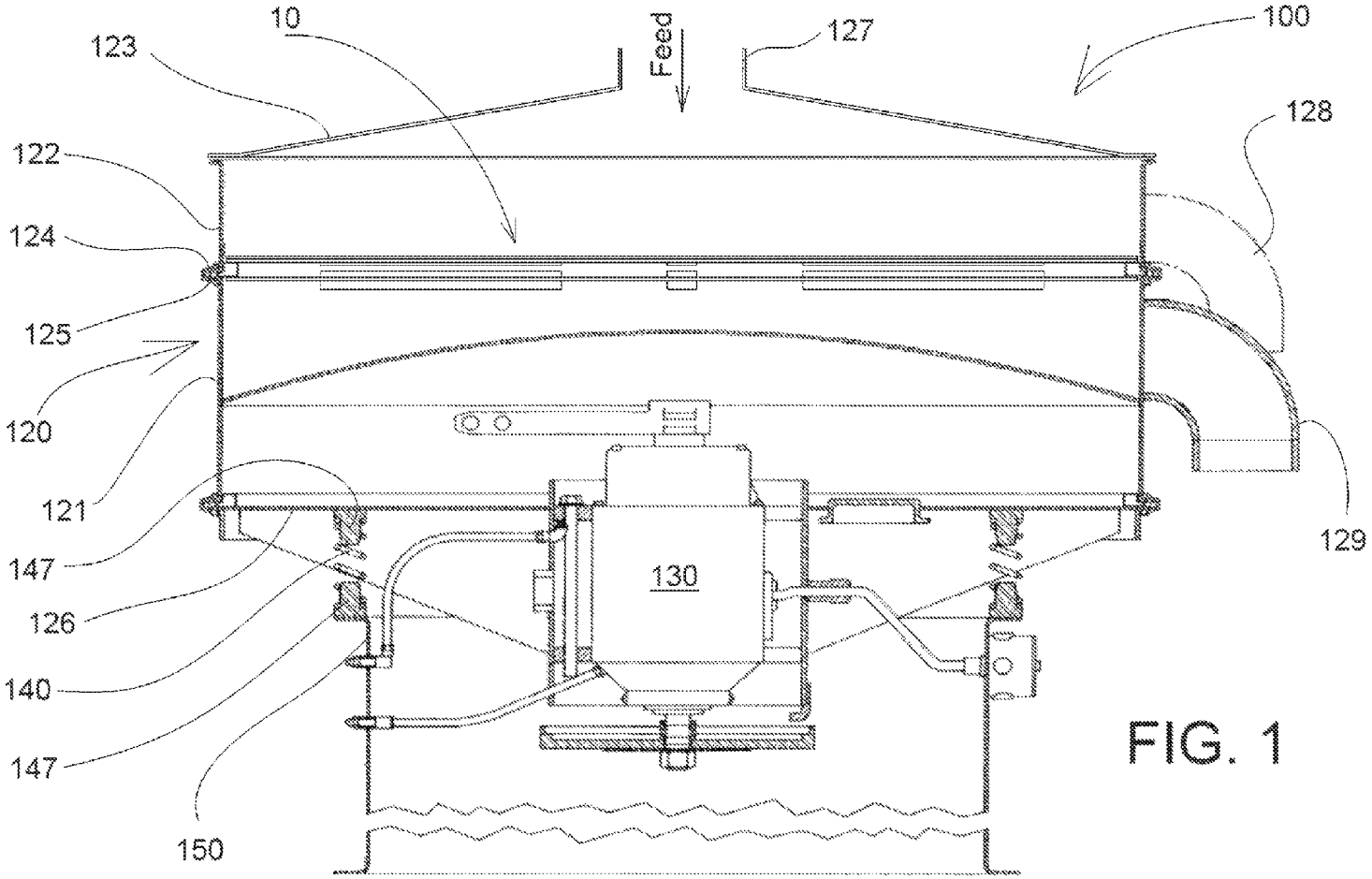
FIG. 1 is a cross-sectional view of the circular vibratory separator demonstrating the allocation therein of the multifrequency self-cleaning sieve assembly according to the present invention.

Referring now to FIG. 1, there is shown a typical one motor circular vibratory separator, referenced generally 100, driven by a single frequency centrifugal vibrator motor 130, however, employing multifrequency self-cleaning sieve assembly, referenced generally 10, constructed and operative in accordance with a preferred embodiment of the present invention. The present invention is intended primarily for screening of powder and bulk materials having a tendency to agglomerate and block sieve surface, and which typically have a particle size in the range from 0.01 to 500 microns.

The separator 100 includes a vibratable housing, referenced generally 120, having a cover 123, a screen assembly 10 clamped in housing 120 between undersize shell 121 and oversize shell 122, and a vibratory motor or exciter 130, mounted onto base plate 126 of housing 120. Motor 130 is typically any suitable single frequency vibratory motor having an operating rotation speed in the range 1000-3600 rpm. Housing 120 has attached thereto a plurality of supports 147, via which it is mounted onto support frame 150 using resilient supports 140, such as suitable springs, thereby to permit a suitable excitation to be set up in the separator 100 while insulating the support frame 150 therefrom. An inlet 127 for ingress of material to be screened, is provided in cover 123; a first outlet 129, located beneath screen assembly 10, is provided in housing undersize shell 121 for exit of undersized material passing through the screen assembly 10; and a second outlet 128 is provided in housing oversize shell 122 for discharging oversize material from separator 100.

It will be appreciated by persons skilled in the art, that alternatively the source of single frequency vibratory excitation may have another construction, for example, "twin"-vibrator system with two self—synchronized vibrators or gyratory drive system as at tumbler separating machines, etc.

It will be also appreciated, that, when a multi-deck separator is used for separation of difficult-to-screen materials onto three and more fraction, a corresponding plurality of multifrequency self-cleaning sieve assemblies may be used in stack-like way and accordingly a plurality of second outlets 128 may be provided at according number of oversize shells 122, wherein only the smallest particles passing through the lower sieve assembly, having the smallest mesh size, exit the single first outlet 129.

In accordance with the present invention, separator 100, while having typically a single source 130 of single frequency excitation, operates as a multifrequency separator, by the mounting therein of a multifrequency self-cleaning sieve assembly 10, constructed and operative in accordance with the present invention. In accordance with the invention, separator 100 may be an existing separator, which is retrofitted by the implementation of the sieve assembly 10 of the present invention. However, alternatively, separator 100 may be constructed from the outset so as to be a multifrequency separator. The precise nature of the multifrequency sieve assembly 10 of the present invention will be understood and appreciated from the description below.

Figure 2:
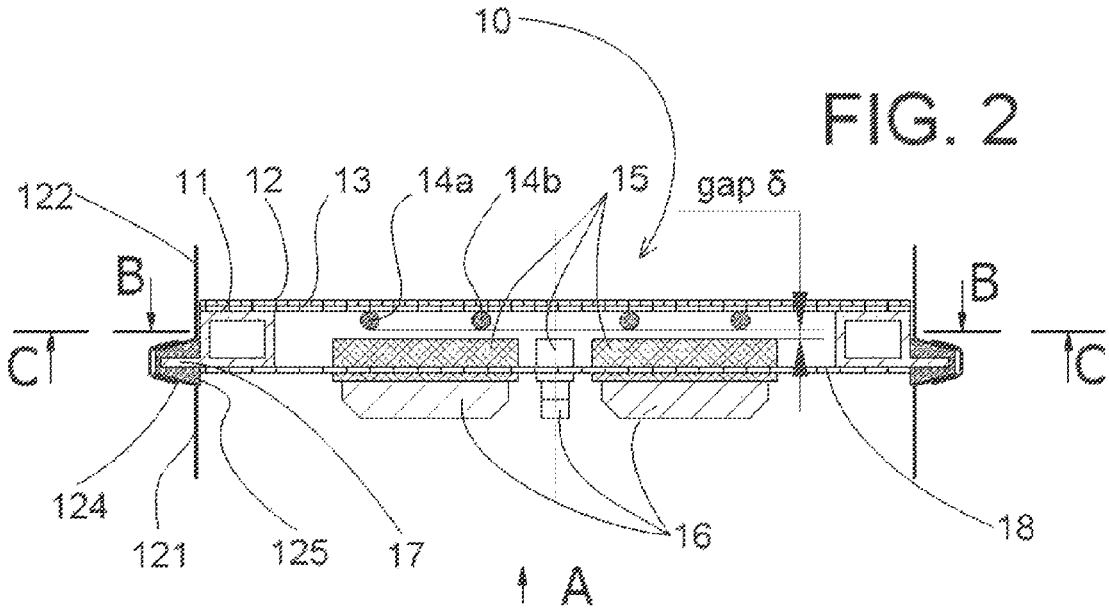
FIG. 2 is a schematic partial cross-sectional view of the sieve assembly, connected to the housing of the separator, according to the present invention.

Referring now particularly to FIG. 2, it is seen that sieve assembly 10 includes a rigid frame 11, which carries thereon a bottom sieve 18 and upper sieve 13, both are stretched out on rigid frame 11 and fixed thereto. Rigid frame 11 is formed as a ring of rectangular tube cross-section and has fixedly attached thereto a flange mounting means 17. It will be understood and appreciated that when any existing vibratory or tumbler separator is retrofitted by the present invention, a standard screen ring of a suitable shape, which is a typical spare part, supplied by manufacturer, may be used as rigid frame 11 for manufacturing of the multifrequency sieve assembly 10 according to present invention.

Upper sieve 13 and bottom sieve 18 are typically any suitable metal or plastic wire woven sieve meshes or punched plates. They are attached at taut state to ring frame 11 using any suitable technique, for example gluing with a suitable cement, welding, bolting, riveting, etc.

Rigid frame 11 is secured to housing 120 (shown partly) by way of mounting means 17 and a gasket-type elastic element 125, which provide elastic attachment of screen assembly 10 between housing undersize shell 121 and housing oversize shell 122. These housing parts are connected by a clamp ring 124, which thus locks the sealed elastic connection of sieve assembly 10 to housing 120 of separator 100.

Additional sieve 12 is flatly superimposed over coarse upper screen 13, under little or no tension and fixed thereto along common perimeter 19, for example, as by suitable cement. Additional sieve 12 is a main sieve of a predetermined appropriate mesh size, according to prescribed cut-size of particle separation, typically a fine sieve in the range 600-35 Mesh having aperture openings in the range 20-500 microns, which can be easily replaced when worn or torn. In this case the apertures of the bottom sieve 18 and upper sieve 13 are 3-10 times coarser than the aperture of the additional sieve, so that to provide an unhindered passageway of the undersized particles passed via additional sieve 12.

It is need to mention that there is no need for additional sieve in some cases, so that the upper sieve 13 also may be used as the main sieve providing a prescribed separation cut size. In these cases bottom sieve 18 has coarser aperture, which is 3-10 times larger, than the aperture of upper sieve 13.

Figure 3:
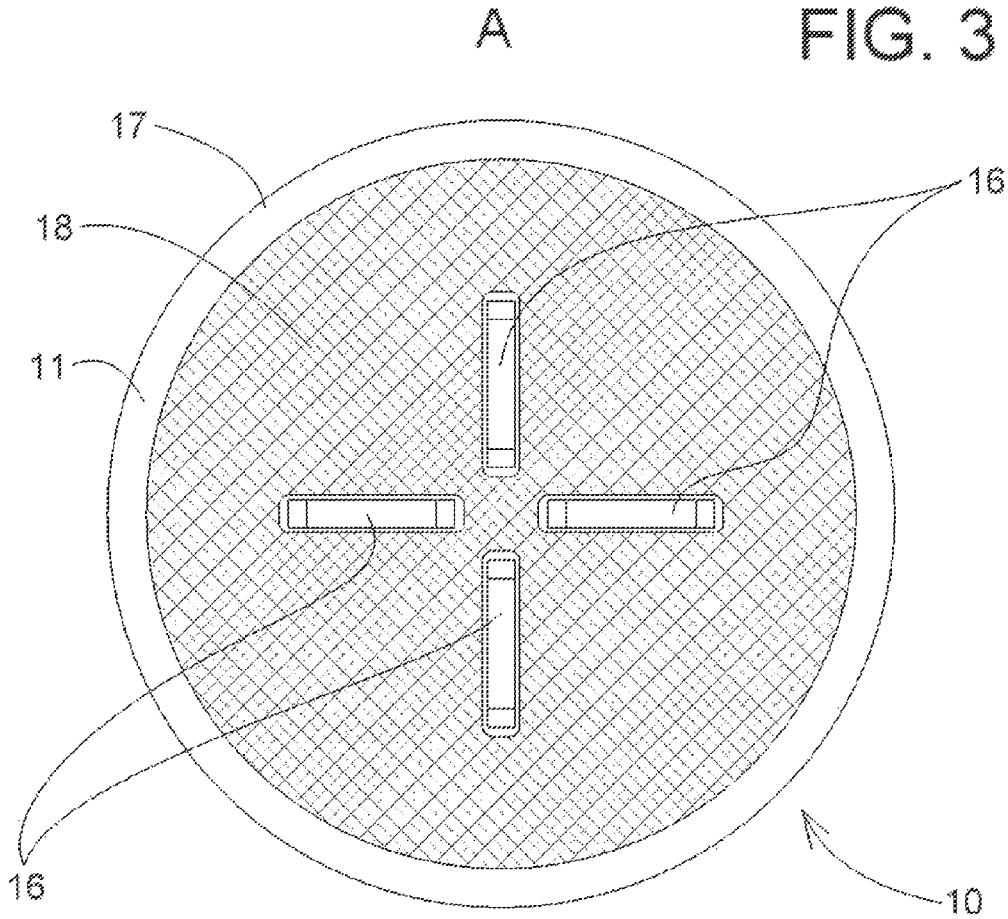
FIG. 3 is a schematic bottom view of the sieve assembly taken in direction A of FIG. 2.
Figure 4:
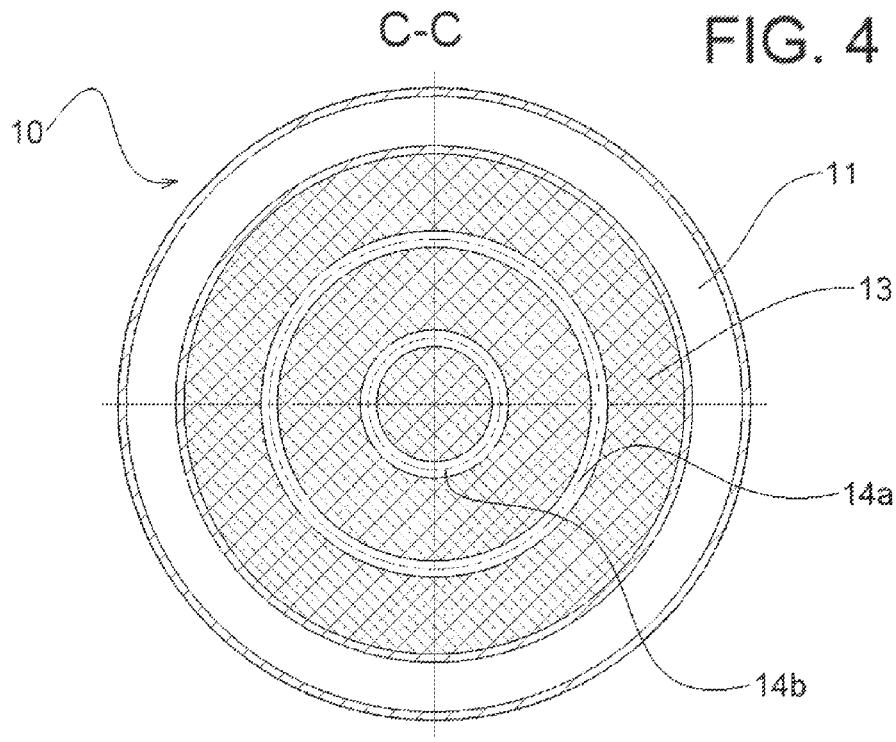
FIG. 4 is a schematic bottom cross-sectional view of the sieve assembly taken in direction C-C of FIG. 2.
Figure 5:
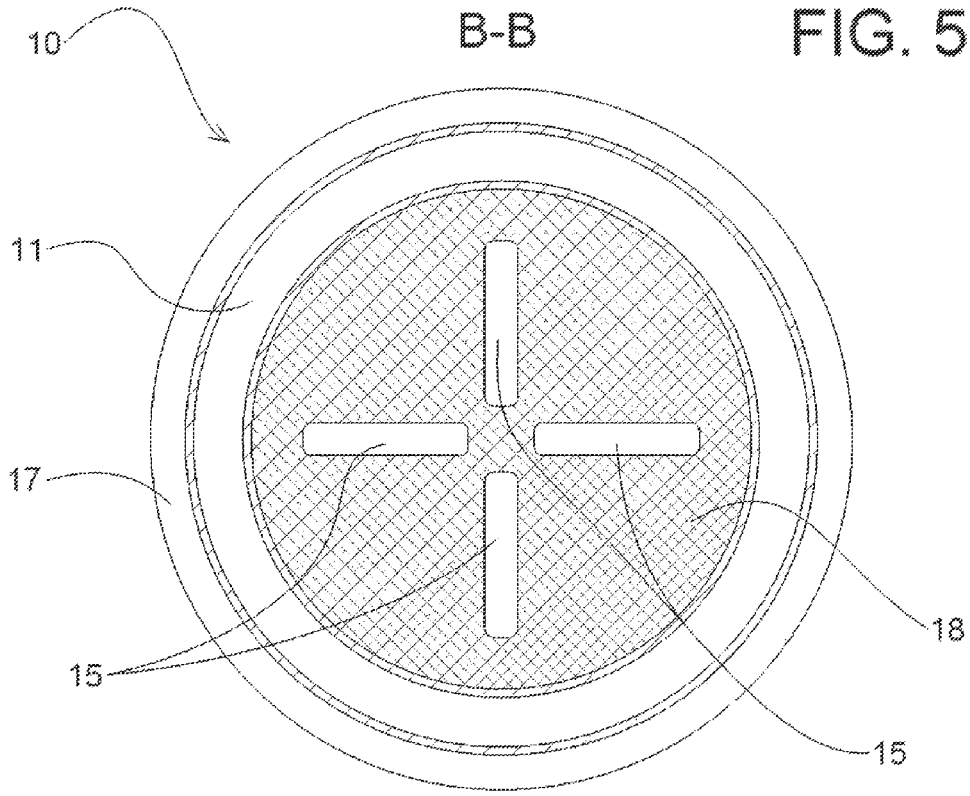
FIG. 5 is a schematic top cross-sectional view of the sieve assembly taken in direction B-B of FIG. 2.

Referring now also to FIGS. 3-5, it is seen that two pairs of radially-elongated actuator means 16 are attached beneath the bottom sieve 18 to its lower surface, symmetrically with regard to the center of rigid frame 11. Actuator means 16 are typically beating inertial elements of suitable shape quantity, etc. parameters, formed from rubber, plastic, metal or other suitable materials or a combination of thereof. Actuator means 16 include wear-proof lining elements 15, which are attached to the upper surface of bottom sieve 18 and associated actuator means 16.

One of the natural frequencies of bottom sieve 18 with actuator means 16 and lining elements 15 attached thereto is selected to be close to the forced frequency of vibration generated by vibratory motor 130, so that to provide intense amplified vibration of the system. It will be appreciated that actuator means 16 and their lining elements 15 may have any suitable quantities, masses, dimensions, shapes, location, etc. characteristics. Precise values of these parameters should be optimized according to analysis of the frequency modes and characteristics of the nonlinear dynamic system.

Two interface apparatuses are formed as interface rings 14*a* and 14*b* and are attached to the lower surface of upper sieve 13 coaxially to ring frame 11. They are aimed to distribute locally applied repeated impact pulses, which are generated by repeated collisions of actuator means 16, over surface area of upper sieve 13, that is why any suitable optimal shape of the interface apparatuses may be used. Interface rings 14*a* and 14*b* 16 are typically formed from rubber, polyurethane, nylon, metal or other suitable materials or a combination of thereof, so that to prevent fast wear of contact surfaces and impure of the separation products. Alternatively, lining elements may be attached to interface apparatuses to form wear-proof contact surfaces.

It is seen in FIG. 2, that actuator means 16 with upper surfaces of their lining elements 15 are arranged relatively to interface rings 14*a*, 14*b* with a prescribed air gap δ therebetween, so that to form elastic buffers, which are necessary for proper conversion of single frequency excitation of separator housing into repeated mechanical pulses and to multifrequency vibration of upper sieve 13. In general case each of these elastic buffers, when in-rest position, may be mounted at non-touching position with positive air gap δ or, alternatively, at touching position without the gap or even pre-pressed with prescribed force (zero or negative gap). It means the provision of elastic portions arranged in either touching or non-touching association, so that to permit the intermittent formation and closing of a gap therebetween, giving rise to intense repeated elastic collisions therebetween. Elastic buffers thus described form a non-linear, unilateral, or non-holding, elastic constraints known in nonlinear dynamics. Therefore, upper screen 13 and bottom sieve 18, both taut on rigid frame 11, actuator means 16, interface apparatuses 14*a*, 14*b* with lining elements 15 form a nonlinear dynamic oscillatory system capable of conversion of single-frequency vibration of the separator housing 120, generated by vibrator motor 130, into multifrequency oscillation of the upper sieve 13 and additional sieve 12 attached thereto.

When the single frequency vibratory motor 130 (FIG. 1) is operated, separator housing 120 receives three-dimensional gyration motion, and thus sieve assembly 10 is excited by vibration of the housing 120, so that actuator means 16, attached to bottom sieve 18 oscillate at prescribed vibration mode of the system "housing—ring frame—bottom sieve—actuators". Similarly, interface apparatuses 14*a*, 14*b* attached to upper sieve 13, receive their vibration from housing 120 via ring frame 11. The dynamic parameters of the oscillation systems are selected so that to provide an optimum phase shift between vibration of actuators 16 and interface rings 14*a*, 14*b*. Prescribed phase shift of vibration of these elements provides repeated collisions of lining elements 15 attached to actuator means 16 with interface rings 14*a*, 14*b* at significant relative velocities. As a major portion of the kinetic energy of actuators 16 and lining elements 15 is thus transferred thereby to interface rings 14*a*, 14*b* and sequentially to upper sieve 13, additional sieve 12 and to material processed on the sieve, the multifrequency system according to the present invention provides self-cleaning operation of sieve assembly 10, and, due to vibratory fluidization simultaneously therewith, de-agglomeration and intense segregation of the material to be screened is also caused.

It should be noted that the interference wave picture at each point of the sieve surface is defined as the superposition of pulse actions from each of the actuator means 16, and, due to gyratory action on the screen assembly 10, the indicated pulses are shifted by the phases. That is why the resulting wave picture usually corresponds to the frequency of the excitation source, multiplied by a quantity of activator devices, i.e., to the regime of multiplication of the excitation frequency with the predominance of the high-frequency components of the normal accelerations of the sieve surface.

Thus, when single-frequency vibration exciter 130 starts, due to proper selection of the system parameters and excitation regime, in this substantially nonlinear dynamic system there is appeared and automatically supported a steady limit cycle of vibration (i.e. attractor). In this mode upper sieve 13 and additional sieve 12 obtain multifrequency excitation with a wide-band Fourier spectrum, close to the discrete or the random spectrum. Since the vibration acceleration is proportional to the square of the frequency, the high-frequency harmonics of the Fourier spectrum cause corresponding high normal accelerations of the sieve surface, which exceed the maximum acceleration of the housing at dozens and hundreds of times and generate the respective huge inertial forces, which act on the particles of material, adhered to the sieve or got wedge at its openings. Thus these particles become detached and exit separator together with the oversize flow. Furthermore, many particles "dance" in the screen openings without clogging of the aperture. Big inertial forces overcome intermolecular and electrostatic adhesive forces, and thus prevent adhesion of moist and sticky particles to the sieve. By this way the blockage of the sieve openings and decrease in the time of the open screen surface is prevented, i.e., the continuous self-cleaning of sieve thus is achieved. Besides, these inertial forces with high magnitudes contribute to disintegration of the particles agglomerates for those difficult-to-screen materials, which, in view of the strong cohesion properties, have trend to agglomerate.

It will be appreciated that the quantity, dimensions and inertial parameters as well as bending stiffness of combination of interface rings 14*a*, 14*b* are selected so that to be sufficient for transferring predetermined impact acceleration in the form of a multifrequency vibration to all portions of the upper sieve 13 and additional sieve 12, thus preventing clogging and blinding of the openings, and providing vibratory fluidization and segregation of the bed, as well as disintegration of particles agglomerates.

It will be also appreciated that the lining elements may be alternatively connected to the interface apparatuses, so that to form a wear-proof contact surface. It is also understood by persons skilled in the art, that under condition of sufficient room between the bottom sieve 18 and upper sieve 13 the actuator means 16 may be fully placed inside this room, and, in some cases, together with the lining elements 15.

Among advantages that have been found by the Inventors in the above-described construction, are the following:

1. Self-cleaning action and agglomeration prevention are performed continuously during operation of the separator, thereby enabling continuous use, without having to stop the machine for periodic manual cleaning of the sieve.

2. The multifrequency sieve assembly is a simple and inexpensive device for retrofitting of existing single-frequency circular separators.

3. With the multifrequency assembly installed screening performance of conventional separator is essentially improved: self-cleaning, bed stirring and quick material segregation essentially increase screening capacity per unit of the sieve area and enhance screening quality.

4. Due to better screening quality the output of the undersize product is typically increased and "impurity" of the oversize product by small particles is reduced.

5. Operation of the system is stable, so that self-cleaning and anti-agglomeration characteristics of the present invention have been found to be retained under essential fluctuations in the feed rate of material to be screened.

6. Proposed dynamic system provides efficient vibratory insulation of the separator housing from impact loads which are localized on the sieve.

Besides, it is need to mention that these advantages of the present invention are provided as a result of employing of multifrequency conversion system according to present invention, in which high deformation potential energy is transformed to the kinetic energy and vice versa inside a confined space, without any increase of the overall dimensions of the separator.

Figure 6:
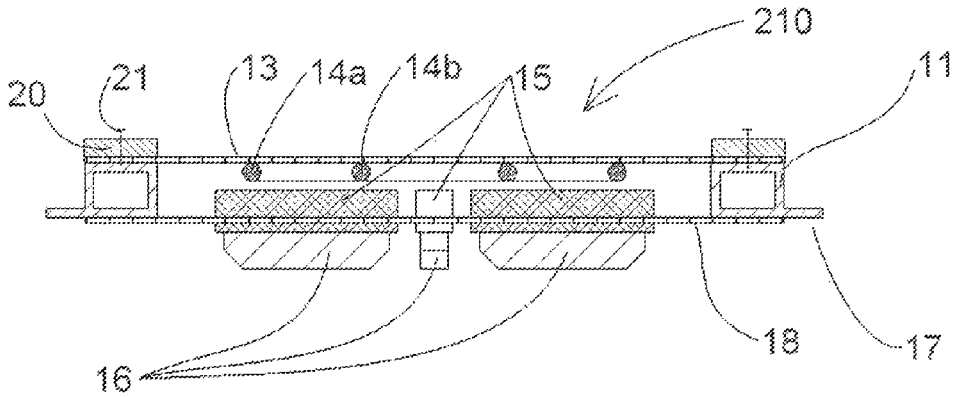
FIG. 6 is a schematic cross-sectional view of the alternative embodiment 210 of the present invention.

Referring now to FIG. 6, there is seen one more embodiment of the multifrequency sieve assembly, referenced 210, which is generally similar to multifrequency sieve assembly 10, shown and described above in conjunction with FIGS. 2-5, but with modification of attachment method for upper sieve 13. For purposes of simplification of production and maintenance operations, also for application flexibility at the cases with frequent changes of materials to be screened, sieve assembly 210 additionally includes an upper ring 20 and attachment means 21. Upper sieve 13 is preliminary taut and fixed on upper ring 20. Then the ring 20 is connected to ring frame 11 by attachment means 21 such as rivets, bolts, studs, clamps, etc.

Figure 7:
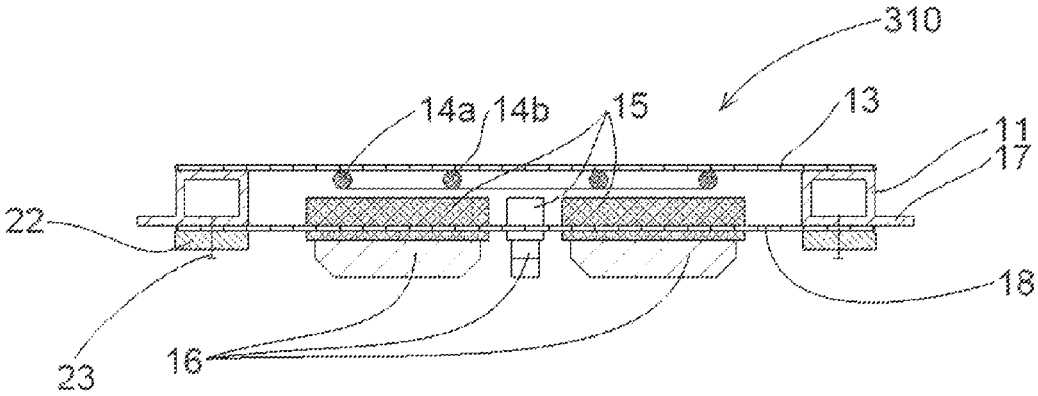
FIG. 7 is a schematic cross-sectional view of one more alternative embodiment 310 of the present invention.

Referring now to FIG. 7, there is seen one more embodiment of the multifrequency sieve assembly, referenced 310, which is also generally similar to multifrequency sieve assembly 10, shown and described above in conjunction with FIGS. 2-5, but with modification of attachment method for the bottom sieve 18. The sieve assembly 310 includes a bottom ring 22 and attachment means 23. Bottom sieve 18 is preliminary taut and fixed on bottom ring 22. The latter is then connected to ring frame 11 by attachment means 23.

Figure 8:
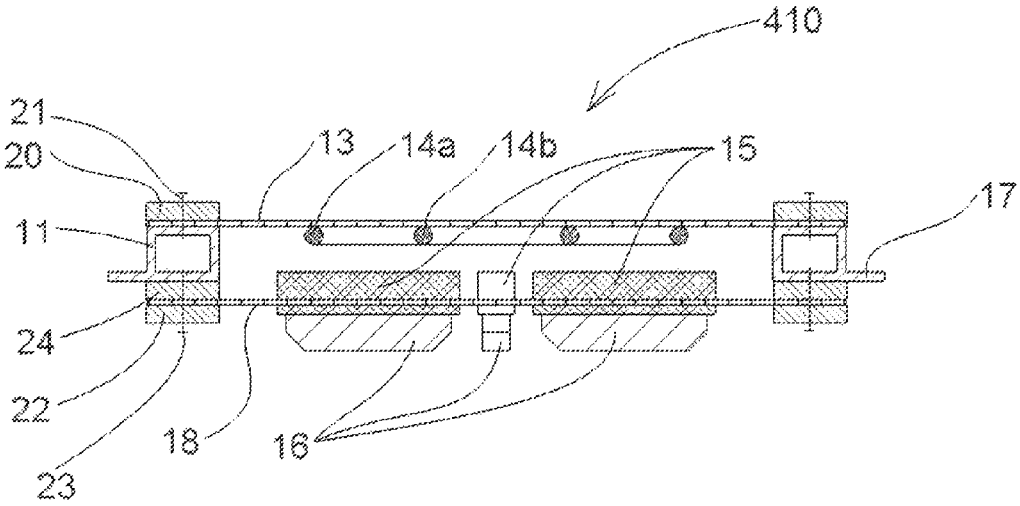
FIG. 8 is a schematic cross-sectional view of one more alternative embodiment illustrating gap adjusting means.

Referring now to FIG. 8, there is seen one more embodiment of the multifrequency sieve assembly, referenced 410, which is generally similar to multifrequency sieve assemblies 210, 310 shown and described above in conjunction with FIGS. 6 and 7, but with modification of attachment method for bottom sieve 18. For purposes of simplification of production and tuning operations, sieve assembly 410 additionally includes a gap adjustment means, shaped here as a washer ring spacer 24, inserted in between bottom ring 22 and rigid frame 11. Insertion or removal of spacers 24 of necessary quantity and thickness allows to adjust optimal multifrequency vibration spectrum by the way of setting prescribed relative position of lining elements 15 of actuator means 16 with regard to interface rings 14*a*, 14*b*.

Figure 9:
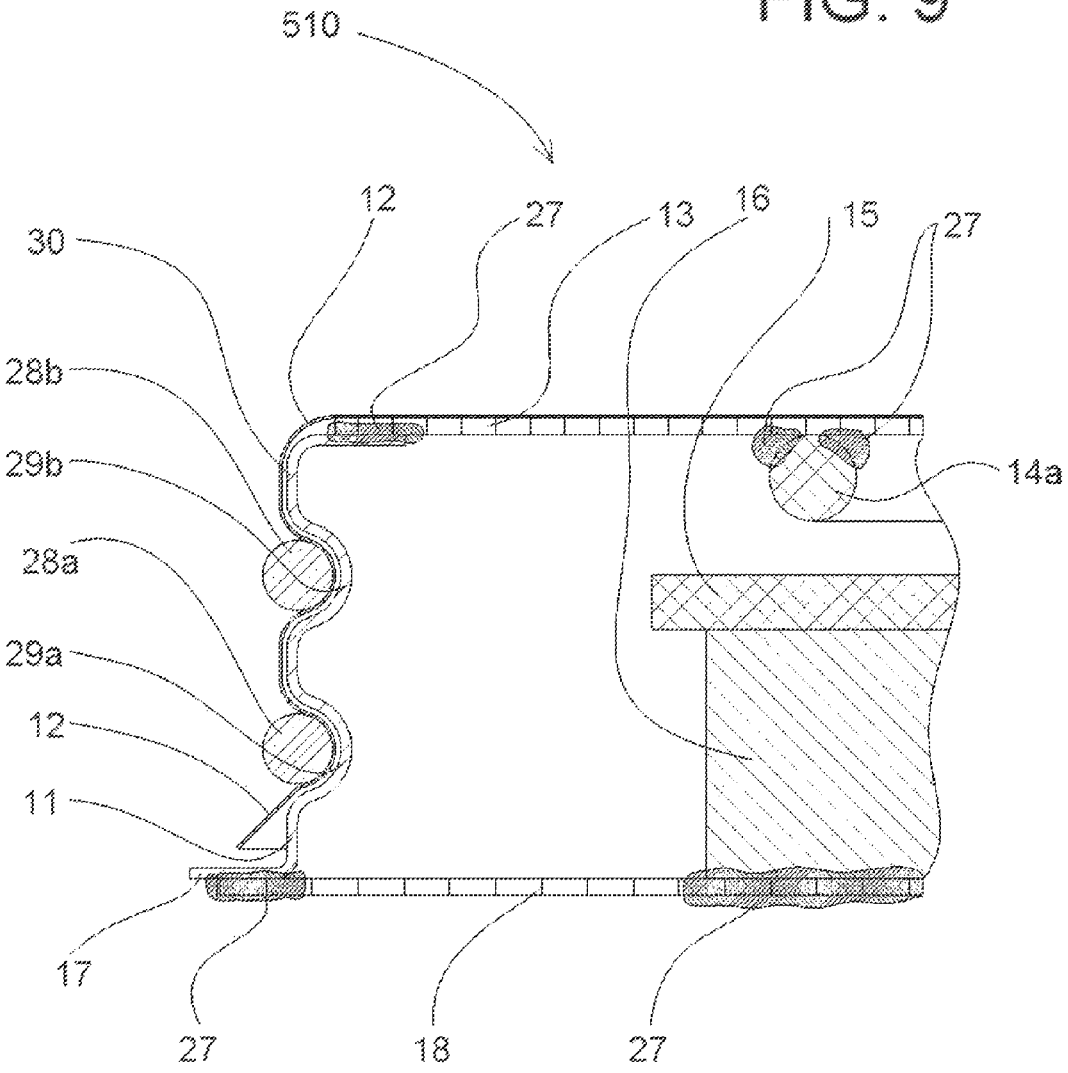
FIG. 9 is a schematic partial cross-sectional view of one more alternative embodiment of the present invention including montage apparatus for replacement and stretching of the additional sieve.

Referring now to FIG. 9, there is seen another preferred embodiment of the sieve assembly, referenced generally 510, which is functionally similar to multifrequency sieve assembly 10 shown and described above in conjunction with FIGS. 2-5, but with arrangement of actuator means 16 in the interior room between bottom sieve 18 and upper sieve 13 as well as with modification of attachment method for additional sieve 12, so that to provide stretching and easy replacement of additional sieve 12. The embodiment is illustrated on the example of typical sieve ring frame 11 with montage means 28 sold by company Cuccolini Sid., (Reggio Emilia, Italy). Rigid frame 11 is formed as a ring of Z-profile with mounting flange 17 arranged for mounting at the separator (not shown). Bottom sieve 18 and upper sieve 13 are taut and attached to the flanges of rigid frame 11 as by suitably cured glue 27.

Ring vertical wall 30 of frame 11 is formed with two circular grooves 29*a*, 29*b*. Additional sieve 12 is taut with possibility of replacement with the use of a montage apparatus 28. By way of example, montage apparatus 28 is represented by ring clamps 28*a*, 28*b* with possibility of their ingress into grooves 29*a*, 29*b* when bolts (not shown) of clamps 28*a*, 28*b* are tighten. Additional sieve 12 is formed as a piece of suitable mesh fabric cut from a standard mesh roll. Firstly the piece is flatly superposes over upper sieve 13 and vertical wall 30 of rigid frame 11. Thereafter it is pressed to rigid frame 11 over its contour by ring clamp 28*a* clamped inside groove 29*a*. Eventually additional sieve 12 is suitably taut by stretching of mesh fabric when clamp 28*b* presses the sieve inside groove 29*b*. Providing suitable tension to additional sieve 12 may be necessary for boosting of the high-frequency components of the frequency spectrum so as the highest harmonics are proved to be responsible for self-cleaning operation of fine sieves when difficult-to-screen ultrafine powder materials are sized.

Figure 10:
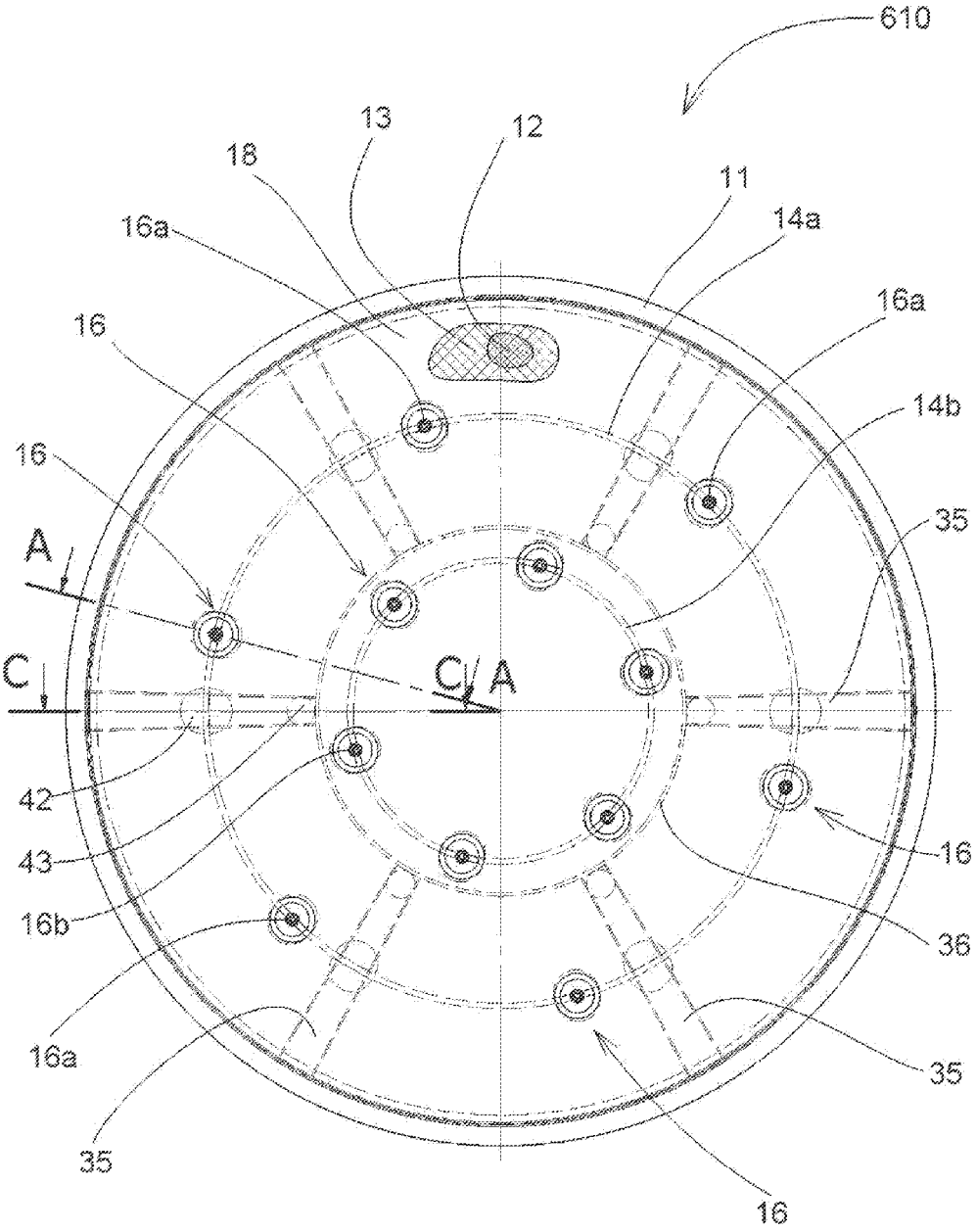
FIG. 10 is a schematic bottom view of another preferred embodiment of the sieve assembly according to the present invention.
Figure 11:
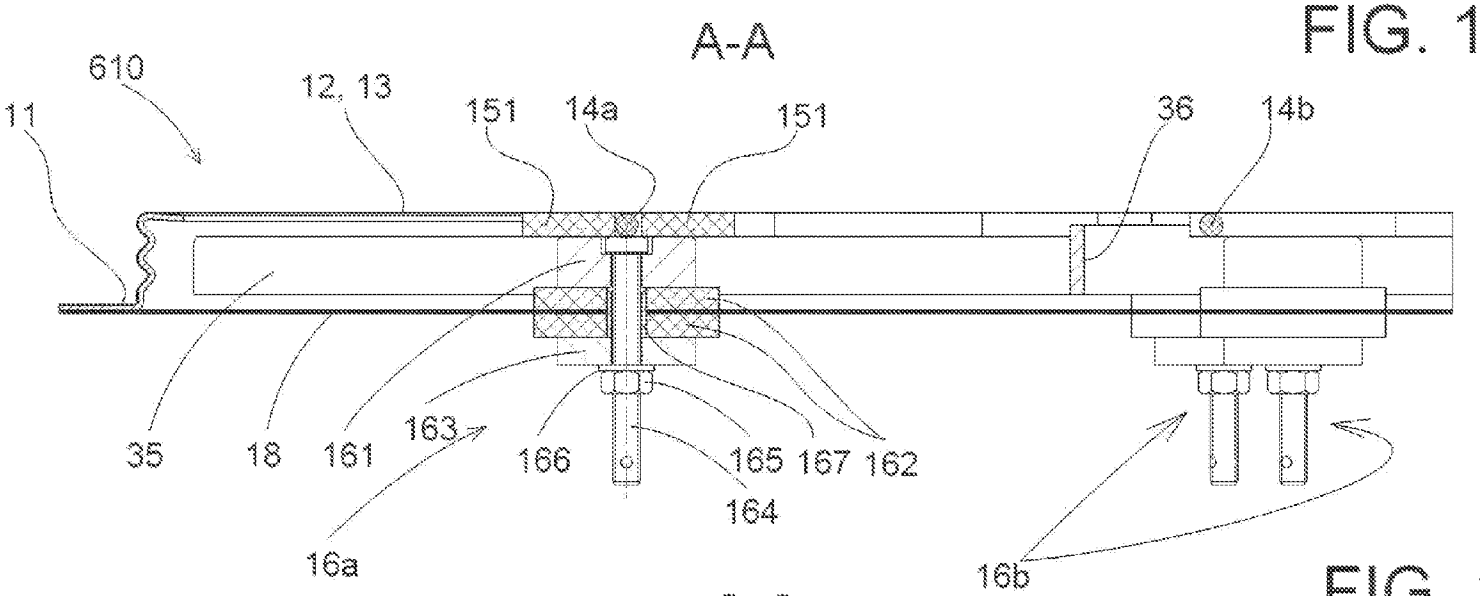
FIG. 11 is a partial schematic cross-sectional view of the sieve assembly taken in direction A-A of FIG. 10.
Figure 12:
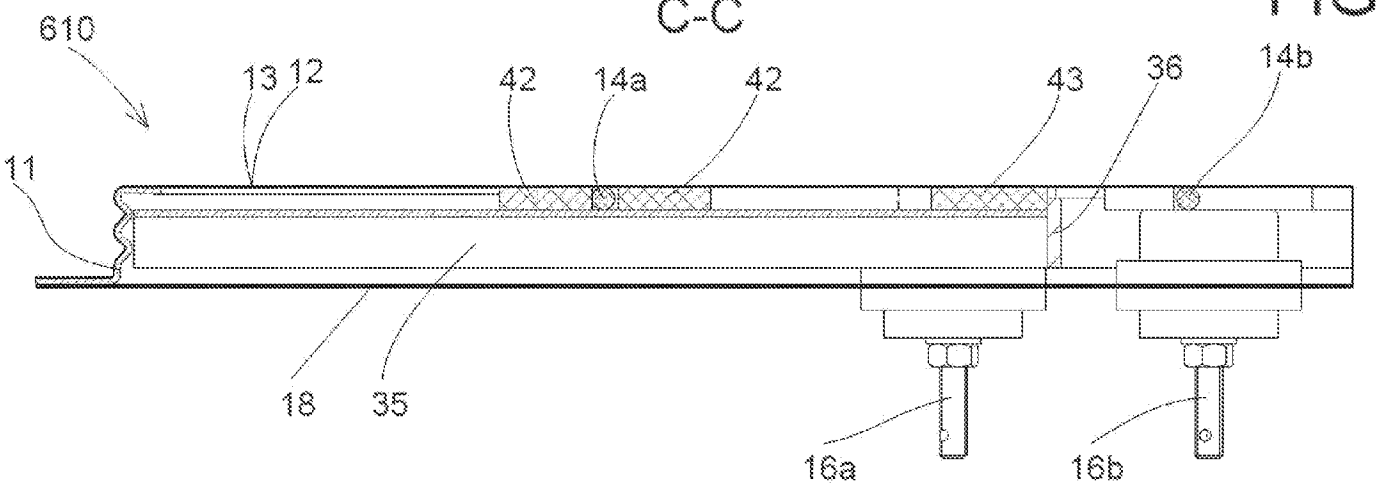
FIG. 12 is a partial schematic cross-sectional view of the sieve assembly taken in direction C-C of FIG. 10.

Referring now to FIGS. 10-12, there is seen yet another preferred embodiment of the multifrequency sieve assembly, referenced generally 610, which is functionally similar to multifrequency sieve assembly 10 shown and described above in conjunction with FIGS. 2-5, but additionally including rigid carrying elements 35, 36 fixedly attached to rigid ring frame 11, and a plurality of buffer apparatuses, formed as buffer elements 42, 43, are arranged against carrying elements 35. Besides, sets of actuator means, referenced generally 16, are attached to taut bottom sieve 18. They are formed with possibility to adjust their mass and inertia moments.

Rigid frame 11 is similar to that shown and described above in conjunction with FIG. 9, but with additional rigid attachment of carrying radial elements 35 and carrying ring element 36, fastened as by welding, so that to provide a suitable bending stiffness to frame 11.

Two sets of actuator means 16 are attached to bottom sieve 18. Set of actuator means 16*a* is arranged against outer interface apparatus 14*a*, while set of actuator means 16*b*—against internal interface apparatus 14*b*. As it is shown in FIG. 11, each of actuator means 16*a*, 16*b* is formed with possibility to adjust the mass and moment of inertia. By the way of example, it includes main actuator portion 161 with fixedly attached screw thread portion 164, one or more additional adjustment portions 163, a pair of mounting protection pads 162, bushing 167, spring washer 166 and nut 165. It will be appreciated by persons skilled in the art, that the total mass and inertia moment of each actuator means may be adjusted and set up during tuning and maintenance procedures by the way of insertion or removal of additional adjustment portions 163 of suitable quantity, shape and location arranged between nut 165 and lower pad 162.

Interface apparatuses 14*a*, 14*b* have protecting lining elements 151 on their surfaces directed to actuator means 16*a*, 16*b*. Wear-proof lining elements 151 are connected to interface apparatuses 14*a*, 14*b* and to upper sieve 13, typically as by proper glue.

Buffer elements 42 are attached to taut upper sieve 13 and interface apparatus 14*a*, while buffer elements 43 are attached to upper sieve 13, so that to form an additional plurality of unilateral non-holding constraints between upper sieve 13 and carrying elements 35. In at-rest position buffer elements 42, 43 may be mounted with air gap or alternatively at contact, and, moreover, to be prepressed, with regard to rigid carrying elements 35. When separator 100 is excited by vibrator motor 130, buffer elements 42, 43 generate repeated mechanical pulses transferred to upper sieve 13 and then to processed material. Buffer elements 42, 43 are typically formed from polyurethane, rubber, nylon or other wear-proof materials or their combination to reduce wear and prevent contamination of processed materials. Buffer elements 42, 43 are attached to upper sieve 13, as by gluing with suitable cement.

It is found by the Inventors, that optimal combination and location of actuator means 16*a*, 16*b* and buffer elements 42, 43 makes possible to boost generation of high frequency harmonics, to increase stability of the system under fluctuations of the load mass, to receive more uniform distribution of multifrequency vibration over the sieve assembly and thus to improve processing of fine and wet materials with high content of "near-sized" and agglomerated particles.

Figure 13:
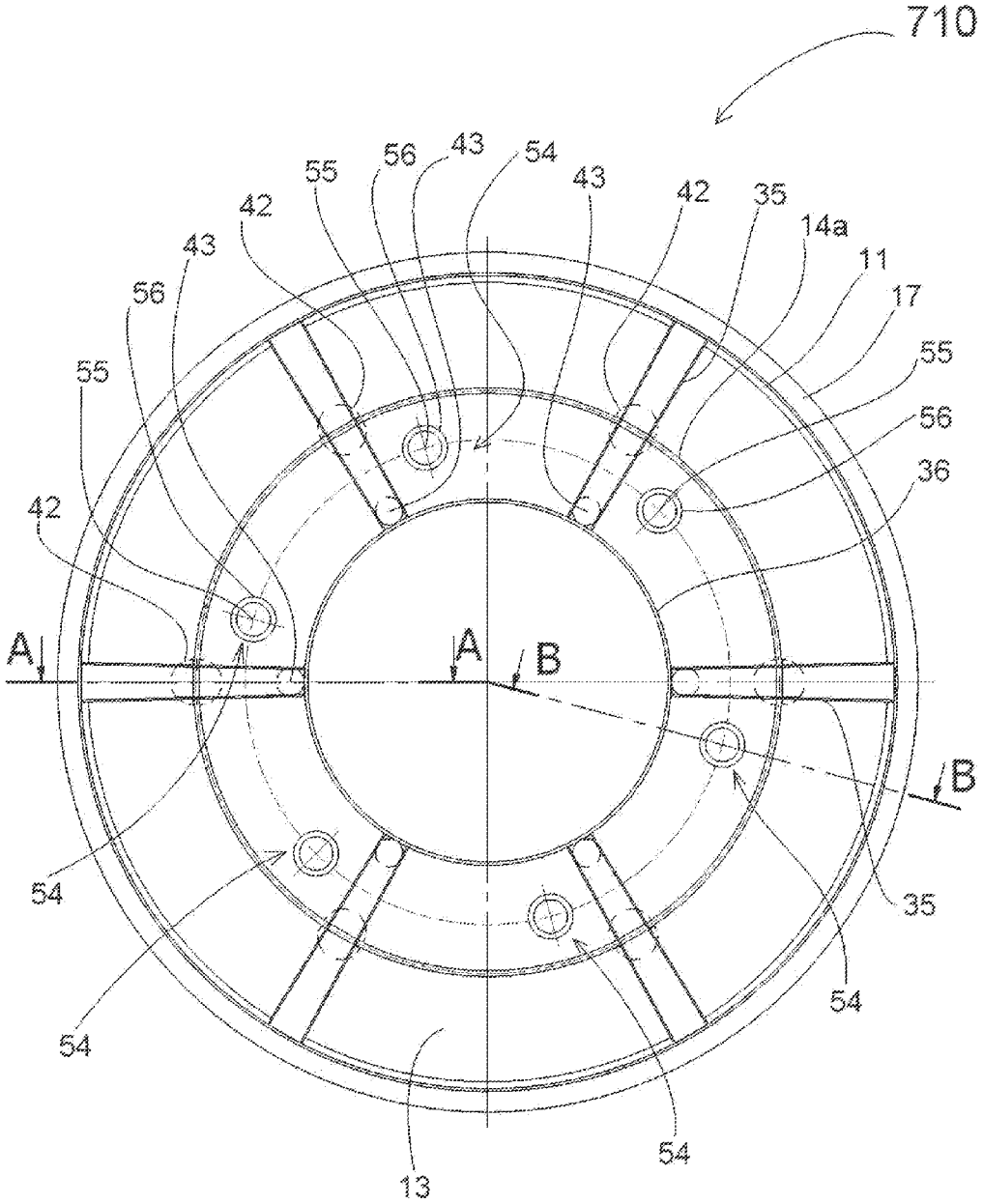
FIG. 13 is a schematic bottom view of the sieve assembly of another preferred embodiment of the present invention.
Figure 14:
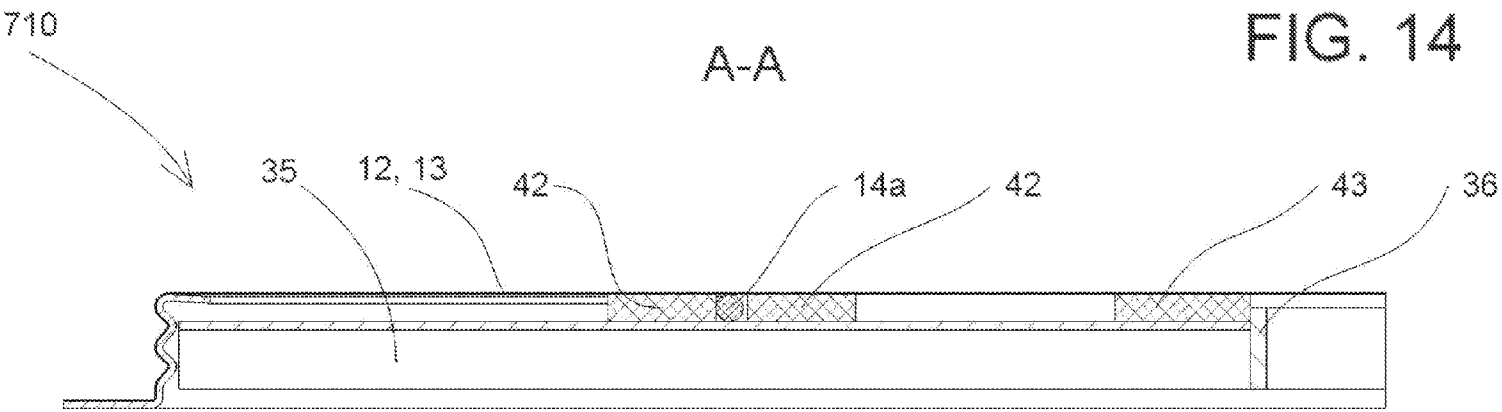
FIG. 14 is a partial schematic cross-sectional view of the multifrequency self-cleaning sieve assembly taken in direction A-A of FIG. 13.
Figure 15:
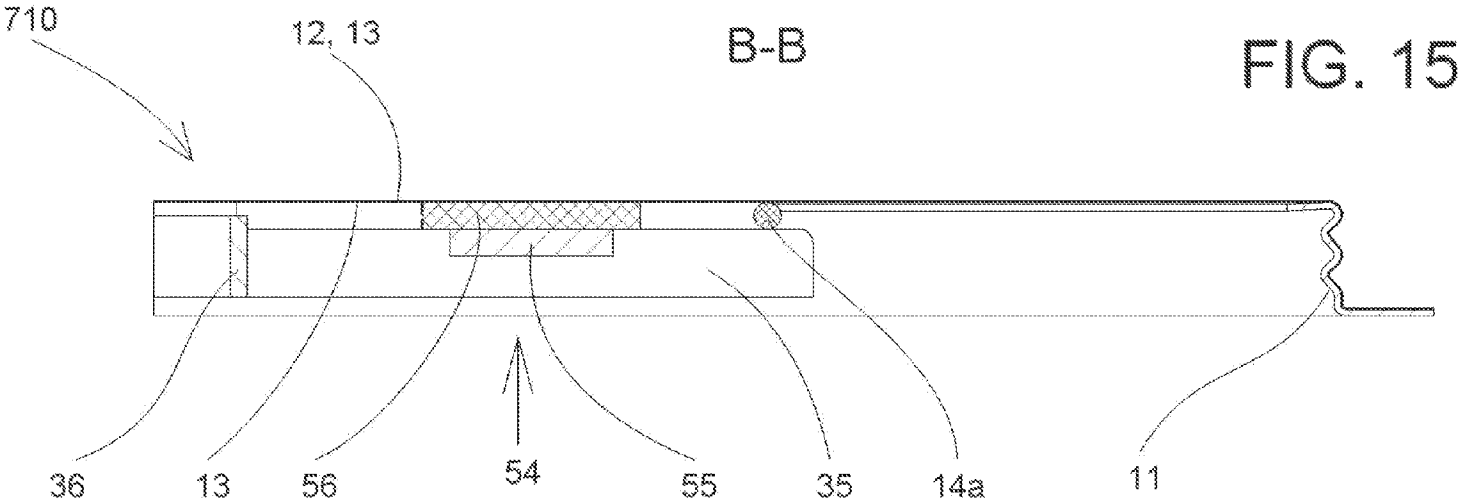
FIG. 15 is a partial schematic cross-sectional view of the multifrequency self-cleaning sieve assembly taken in direction B - B of FIG. 13.

Referring now to FIGS. 13-15, there is seen yet another preferred embodiment of the multifrequency sieve assembly, referenced generally 710; the latter is functionally similar to multifrequency sieve assembly 610 shown and described above in conjunction with FIGS. 10-13. Assembly 710 is simplified by excluding actuator means and bottom sieve; however, it additionally includes a plurality of inertial apparatuses, generally referenced 54, which are attached to upper sieve 13. Frame 11 includes rigid carrying elements 35, 36 fixedly attached to rigid ring frame 11. Buffer elements 42, 43 are arranged against carrying elements 35. Buffer elements 42 are attached to taut upper sieve 13 and a single interface apparatus 14*a*, and buffer elements 43 are attached only to upper sieve 13, so that to form a plurality of unilateral non-holding constraints between upper sieve 13 and carrying elements 35.

As it is shown in FIG. 15, each inertial apparatus 54 includes weight portions 55 connected to upper sieve 13 via protection pad portions 56. Weight portions 55 are typically any suitable massive elements formed from metal, rubber, plastic or other suitable materials or a combination thereof. Protection pad portion 56, by way of example only, is a suitable elastomeric pad, which is capable to reduce sieve contact stresses. It is connected to upper sieve 13, as by gluing, vulcanization, etc. Inertial elements may be formed with possibility to adjust their mass and inertia moments. By way of example only, such adjustment means may be formed in the manner shown and described in conjunction with adjustable actuator means 16 shown in FIG. 11. Optimal localization and mass setting for the plurality of inertial elements 54 gives essential rise of kinetic energy of upper sieve 13 and additional sieve 12, thus amplifying the normal peak acceleration and impulse of forces generated by buffer elements 42, 43. In this case one the most reasonable is the simultaneous connection of inertial apparatuses 54 to upper sieve 13 and the interface apparatuses 14, and also in proximity of the buffer elements 42, 43, so that interface apparatuses 14 are used as waveguides with the minimum losses of vibrational energy.

It is found by the Inventors, that assembly 710 is inexpensive simplified construction. Optimal location and proper setting of parameters of inertial elements 54 and buffer elements 42, 43 makes possible to boost local acceleration of the sieve 13, to receive more uniform distribution of multifrequency vibration over the sieve assembly and thus to improve processing performance for fine powders, wet and sticky materials as well as dense slurries—in comparison to single frequency conventional separators.

It is need to mention, however, that embodiment 710 typically provides lesser excitation energy to upper sieve 13, than embodiments, which include actuator means and bottom sieve. This fact may cause limitations in application fields for embodiment 710. Also, it is need to mention, that the embodiments designated 610 and 710, contrary to embodiments designated 10, 210, 310, 410 and 510, are differed by the reactive impulses, transferred by buffer elements 42, 43 to rigid frame 11 and sequentially to housing 120. By this reason, in the case of retrofitting an existent separator, the housing elements should be rigid enough and have high natural frequencies of elastic vibrations.

Figure 16:
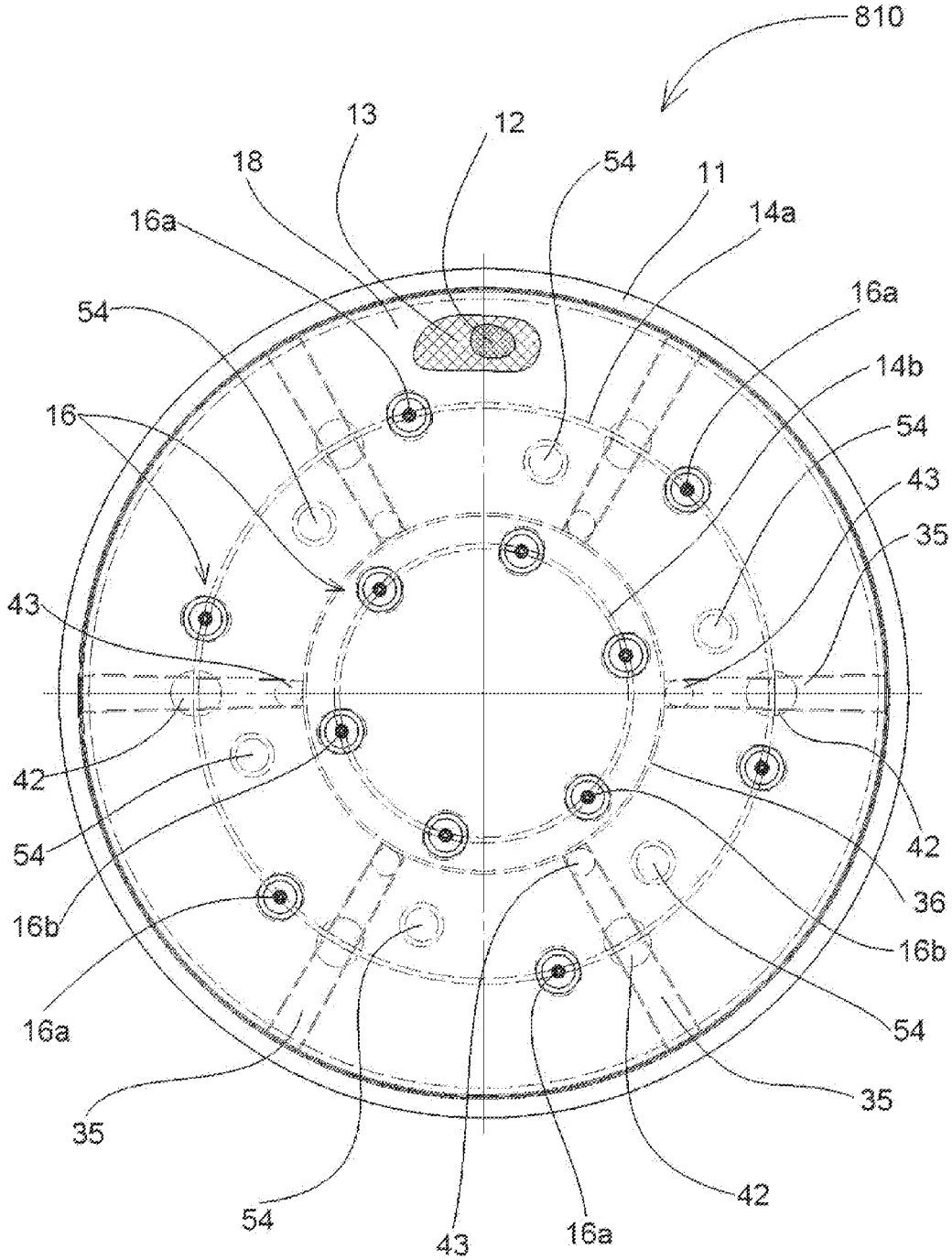
FIG. 16 is a schematic bottom view of the sieve assembly of yet another preferred embodiment of the present invention.

Yet another embodiment of the multifrequency sieve assembly, generally designated 810, is shown in FIG. 16. It includes: two sets of actuator means 16*a*, 16*b*, attached to the bottom sieve 18 and arranged against interface apparatuses 14*a*, 14*b*, attached to upper sieve 13; two sets of buffer elements 42, 43, arranged against rigid radial elements 35, which are fastened to frame 11; and additional set of inertial apparatuses 54. All enumerated parts were described in details and shown above in conjunction with embodiments 610, 710 illustrated in FIGS. 10-15, that is why we do not describe them again.

The Inventors found, that embodiment 810 has extended application field due to high energy excitation transferred to upper sieve 13, additional sieve 12 and to the material to be processed. It is need to mention, that additional, in comparison to embodiment 610, connection of inertial apparatuses 54 to upper sieve 13, creates additional phase shift between vibration of upper sieve 13 and actuator means 16*a*, 16*b*. As the result, opposing movement with increased relative velocities of collided elements takes place; it creates more uniform vibration field and boosts excitation energy of the sieves 12, 13, improving self-cleaning performance and stability of the operation modes under essential variations of the material feed rate.

It will thus be appreciated by persons skilled in the art, that the scope of the present invention is not limited to what has been specifically shown and described hereinabove, merely by way of illustrative examples. Rather, the scope of the present invention is limited solely by the claims, which follow.

The invention claimed is:

1. A vibratory separator for sizing of particulate material, the separator comprising:

a vibratable housing, at least one sieve assembly, connected to said housing, at least indirectly, the sieve assembly is constructed to divide the material into fine particles and coarse particles according to a prescribed separation cut size, and a source of single frequency vibratory excitation for exciting the housing of the separator so as to separate particulate material provided thereto, wherein said at least one sieve assembly comprises, and a taut bottom sieve, the bottom sieve having a larger aperture opening size than said separation cut size; the bottom sieve comprising at least one beating inertial actuator;

the beating inertial actuator having a specific location, size, shape and mass to provide optimal characteristics of a multifrequency excitation of the upper sieve and separation of the particulate material;

at least one interface apparatus, connected to said upper sieve, the interface apparatus having a specific location, size, shape, and mass to provide an optimal distributed multifrequency vibration over the whole sieve area of said upper sieve; and wherein each said, at least one beating inertial actuator is arranged with regard to said at least one interface apparatus so that to generate prescribed repeated collisions therebetween and transmit vibratory-impact excitation to said at least one interface apparatus and to set, in non-linear fashion, the characteristics of the multifrequency excitation, transmitted therebetween, and operative to cause a corresponding multifrequency excitation and self-cleaning of said upper sieve and de-agglomeration of the material to be screened, when said sieve assembly is exposed to single frequency excitation from said source of single frequency vibratory excitation together with said vibratable housing, and wherein the forced frequency of said at least one source of single frequency vibratory excitation is close to one of the natural frequencies of said bottom sieve together with the elements connected thereto, so as to provide a resonant amplification of vibration of said bottom sieve.

2. The separator according to claim 1, further comprising a distance δ (delta) between said actuator of the bottom sieve and said interface apparatus of the upper sieve, with possibility of adjustment of said distance, delta, to provide an optimal frequency spectrum of vibratory excitation of said upper sieve for multifrequency separation of the particulate material.

3. The separator according to claim 1, further comprising an additional sieve of a prescribed separation cut size, and said additional sieve is superimposed over said upper sieve, with both said upper sieve and said bottom sieve having a larger aperture opening size than the separation cut size of said additional sieve.

4. The separator according to claim 1, and also including a gap adjustment means for adjusting relative position between said at least one beating inertial actuator and said at least one interface apparatus.

5. The separator according to claim 1, wherein said at least one beating inertial actuator also includes at least one lining element connected thereto from the side of said at least one interface apparatus, so that to provide wear-proof contact surface.

6. The separator according to claim 1, wherein said at least one beating inertial actuator is formed with possibility of adjustment of the mass and inertia moments thereof.

7. The separator according to claim 1, wherein said taut upper sieve and said taut bottom sieve are connected, at least indirectly, to a rigid frame, and also including at least one rigid carrying element connected to said rigid frame and at least one buffer apparatus connected to said upper sieve, and wherein said at least one buffer apparatus is arranged as a unilateral non-holding constraint of said upper sieve with regard to said at least one rigid carrying element.

8. The separator according to claim 7, wherein said at least one buffer apparatus is additionally connected to said at least one interface apparatus.

9. The separator according to claim 1, and also including at least one inertial apparatus connected to said upper sieve.

10. The separator according to claim 9, wherein said at least one inertial apparatus is additionally connected to said at least one interface apparatus.

11. The separator according to claim 9, wherein said at least one inertial apparatus is formed with possibility of adjustment of the mass and inertia moments thereof.

* * * * *

UNITED STATES PATENT AND TRADEMARK OFFICE

CERTIFICATE OF CORRECTION

PATENT NO. : 8,485,364 B2
APPLICATION NO. : 13/251397
DATED : July 16, 2013
INVENTOR(S) : Iona Krush et al.

It is certified that error appears in the above-identified patent and that said Letters Patent is hereby corrected as shown below:

In the Claims

Please insert a phrase --a taut upper sieve,-- after the word "comprises," and before the word "and" in Column 13, line 22.

Signed and Sealed this
Sixth Day of May, 2014

Michelle K. Lee

Michelle K. Lee
*Deputy Director of the United States Patent and Trademark Office*